United States Patent [19]

Gezari

[11] 4,285,515

[45] Aug. 25, 1981

[54] SURGICAL ERGOMETER TABLE

[76] Inventor: Daniel Y. Gezari, 317 Bradley Blvd., Bethesda, Md. 20034

[21] Appl. No.: 81,565

[22] Filed: Oct. 3, 1979

[51] Int. Cl.[3] ..... A63B 23/04; A63B 69/16

[52] U.S. Cl. ..... 272/73; 272/134; 272/DIG. 4; 128/707; 128/774; 269/325; 269/328

[58] Field of Search ..... 128/670, 671, 774, 707; 73/379; 272/73, 134, DIG. 4, DIG. 6; 269/322, 325, 328

[56] References Cited

U.S. PATENT DOCUMENTS 2,784,591 3/1957 Shoor ..... 272/73 X 3,057,201 10/1962 Jaeger ..... 272/DIG. 6 X 3,744,480 7/1973 Gause et al. ..... 128/707

*Primary Examiner*—Kyle L. Howell

*Attorney, Agent, or Firm*—Charles E. Temko

[57] ABSTRACT

A cardiac stress table employing a cycle type ergometer upon which a patient can be supported during exercise for scintillation camera scanning. The table includes means for adjusting the pedals of the ergometer both longitudinally of the table and vertically with respect to a seat for the patient. A back-supporting member is pivotally adjustable relative to the seat. Counterbalancing means is provided to facilitate lifting of the ergometer during vertical adjustment.

5 Claims, 5 Drawing Figures

SURGICAL ERGOMETER TABLE

BACKGROUND OF THE INVENTION

This invention relates generally to the field of surgical tables, and more particularly to an improved table adapted to support a patient for observation of the result of cardiac stress using scintillation camera equipment while the patient develops a predetermined or measured amount of work. Most conveniently, this is accomplished using a pedal operated ergometer.

Cycle type exercise machines are well known in the exercising device art. Such devices normally include a seat for the occupant, a pair of handle-bars to support him in normal cycle riding position, and a sprocket-driven fly-wheel responding to normal pedaling motion. A caliper type brake is also provided to vary the amount of work necessary to turn the pedals.

Unfortunately, when using such devices, a patient is not positioned for camera scanning, and such scanning cannot normally be made unless the position is in an at least partially inclined position.

While the attachment of a known ergometer to one end of a table is a relatively simple matter, prior art constructions not having any means for adjustment of the ergometer relative to the table have resulted in positioning the patient such that operation of the ergometer has resulted in the patient moving his legs to a position wherein the knees and/or thighs contact the scintillation camera, disturbing both the patient and the process of observation. Further, his operation of the ergometer is uncomfortable, and due to lack of adequate support, there is inadequate patient restraint to permit accurate observations to be made.

SUMMARY OF THE INVENTION

Briefly stated, the invention contemplates the provision of an improved surgical table particularly adapted for the supporting of a patient for the comfortable operation of a foot-powered ergometer. The ergometer is adjustably positioned at an end of the table whereby the location of the crankshaft axis of the pedals may be raised or lowered relative to the surface of the table, and longitudinally moved to lengthen or shorten the distance from said axis, in accordance with the location of the hips of a patient. Counterbalancing springs enable the ergometer to be lifted without difficulty prior to locking in desired position. A pivotally mounted back supporting member is partially counterbalanced and is provided with patient restraining straps and shoulder pads preventing slipping in either an upwardly or downwardly direction during exercise. A countoured seat further restrains patient motion during exercise.

BRIEF DESCRIPTION OF THE DRAWINGS

In the drawing, to which reference will be made in the specification, similar reference characters have been employed to designate corresponding parts throughout the several views.

DETAILED DESCRIPTION OF THE DISCLOSED EMBODIMENT

Figure 1:
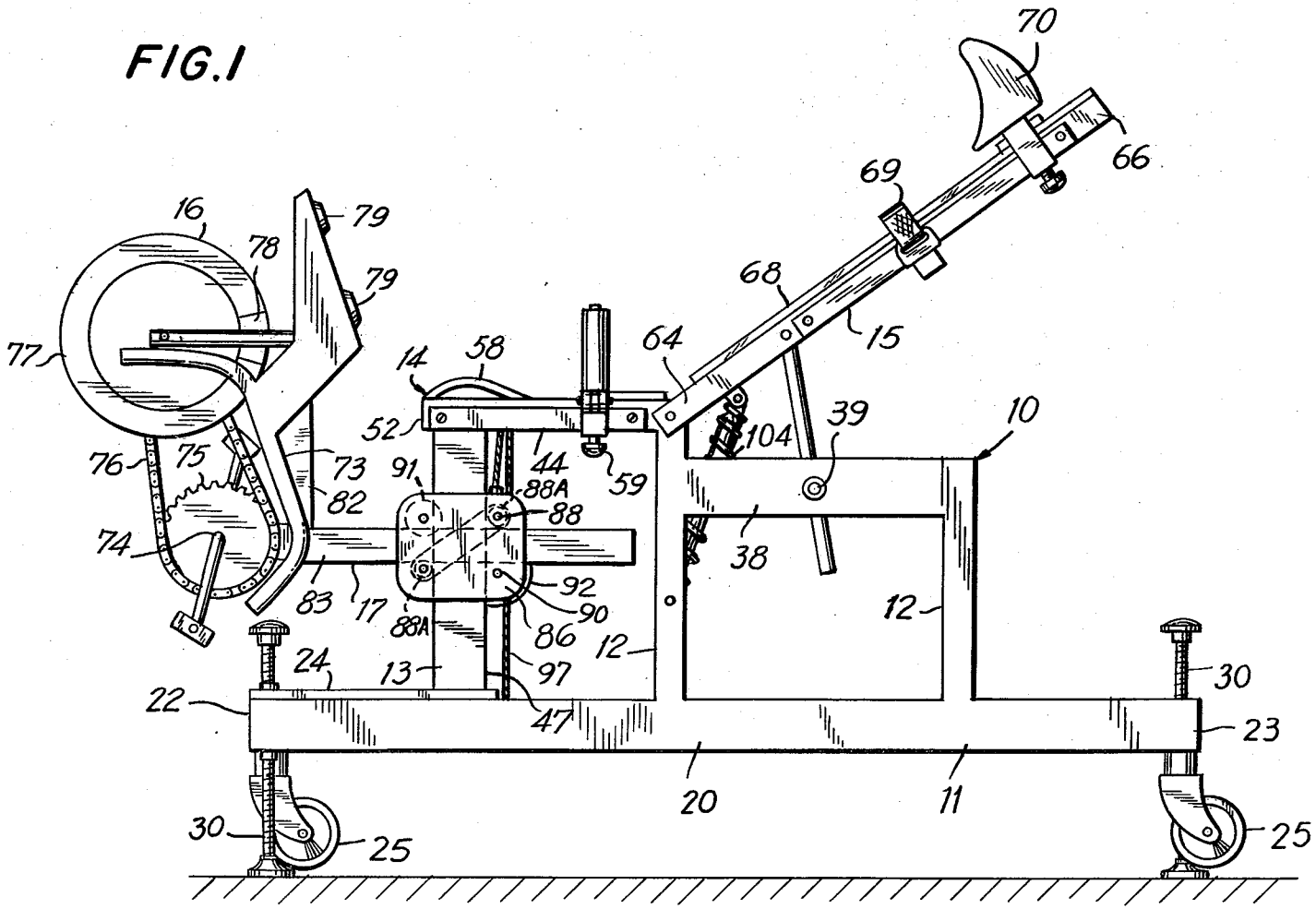
FIG. 1 is a side elevational view of an embodiment of the invention.
Figure 3:
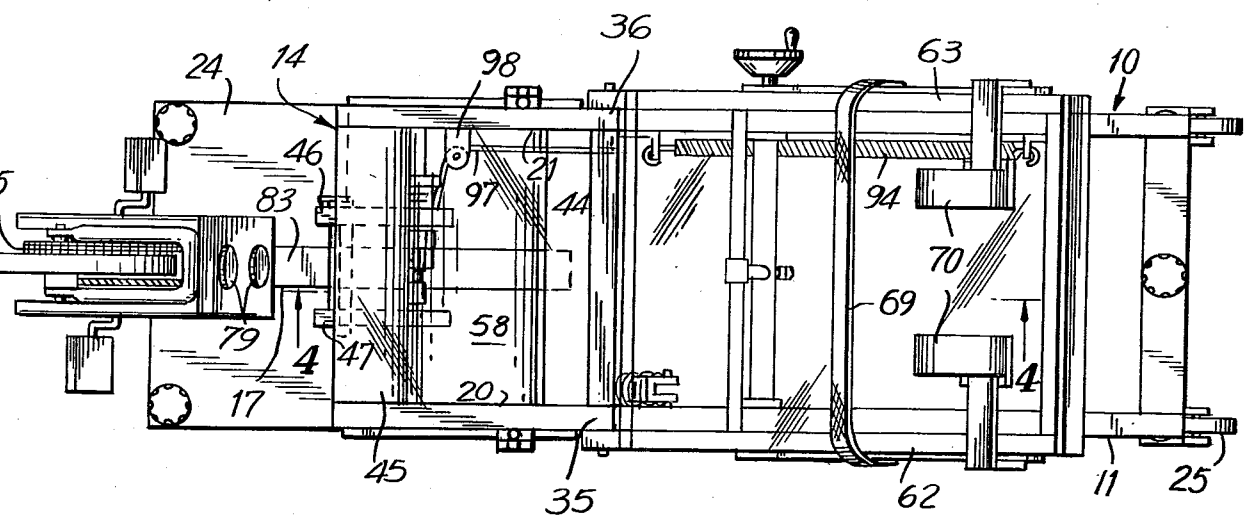
FIG. 3 is a top plan view thereof.
Figure 2:
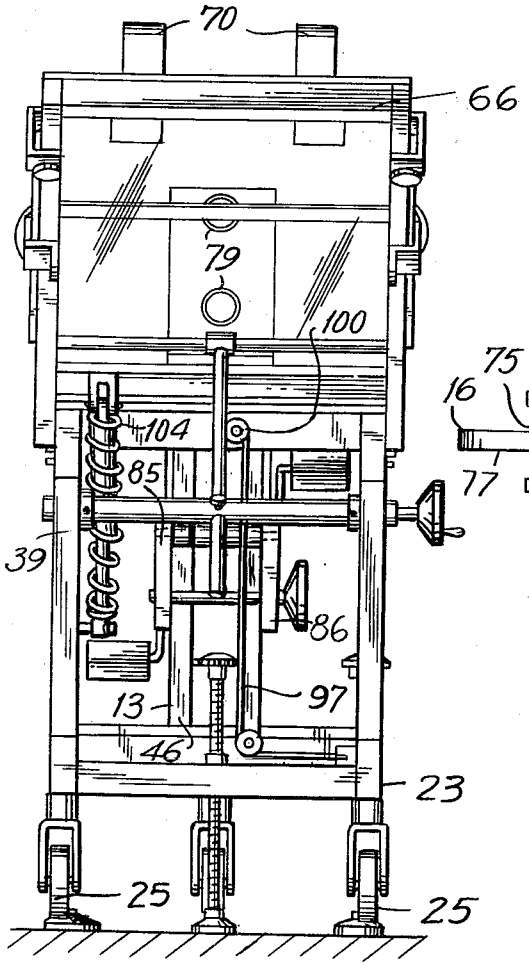
FIG. 2 is an end elevational view thereof.
Figure 4:
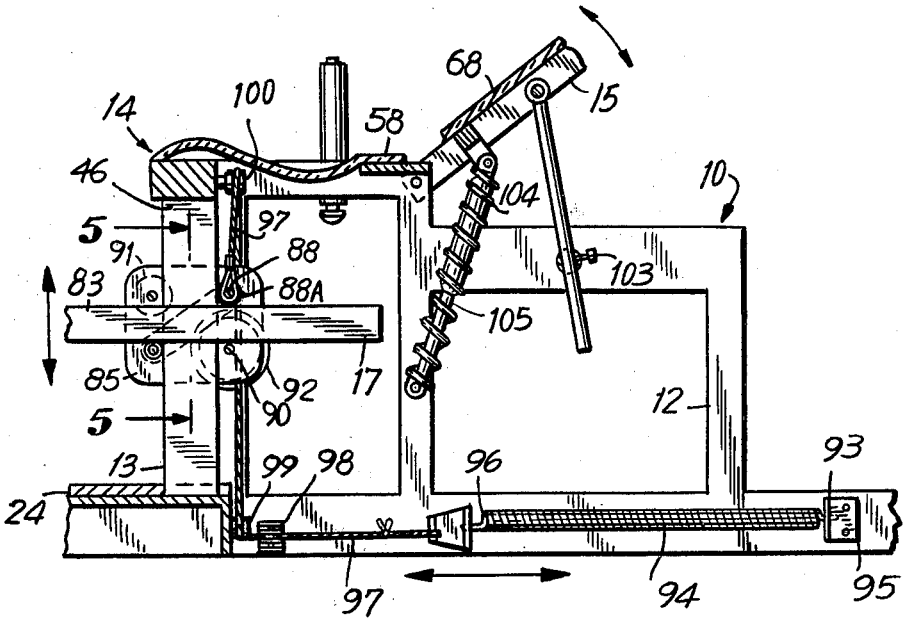
FIG. 4 is a fragmentary vertical sectional view as seen from the plane 4—4 in FIG. 1.
Figure 5:
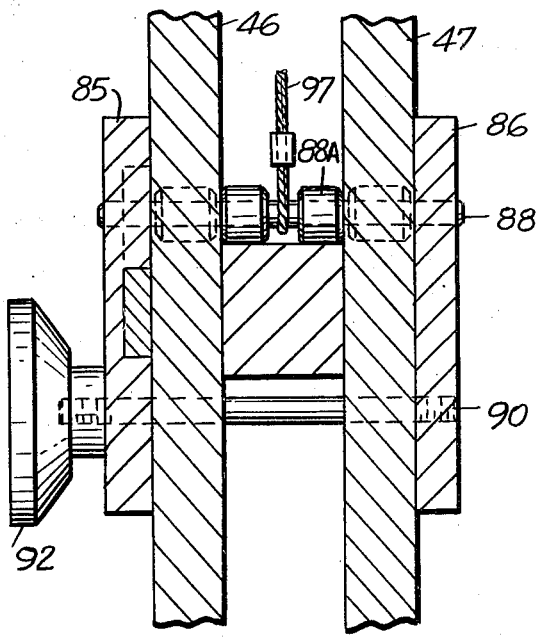
FIG. 5 is a fragmentary sectional view as seen from the plane 5—5 in FIG. 1.

In accordance with the invention, the device, generally indicated by reference character 10, comprises broadly: a generally horizontal base element 11, a first vertical support element 12, a second vertical support element 13, a seat element 14, a back rest element 15, an ergometer element 16, and an ergometer support element 17.

The base element 11 is preferably of welded steel construction, and includes first and second longitudinal rails 20 and 21, respectively, interconnecting at the ends thereof first and second transverse rails 22 and 23, respectively. Supported upon the upper edges of the rails 20–22 is a foot-supporting platform 24. The base element 11 is supported upon a floor or other horizontal surface by a plurality of caster elements 25, and a plurality of elevator elements 30, the use of which selectively removes the weight of the device 10 from the floor, and enables it to be anchored in relatively fixed location.

The first vertical support element 12 supports the rear portion of the seat element 14 and a first end of the back rest element 15. It includes a left-hand member 35, and a right-hand member 36, each of which are generally inverted U-shaped. The upper longitudinal members 38 of each support a transverse rod 39 which forms part of the means for adjusting the back rest element.

The second vertical support element 13 interconnects with the first support element 12 and includes first and second horizontal members 44 and 45 and third and fourth vertical members 46 and 47 which are spaced relatively closely to define an interstice therebetween.

The seat element 14 includes a generally rectangular frame 52 supporting an overlying plate 58 of either planar or contoured configuration. The frame is also provided with a pair of adjustable hand grips 59 which may be grasped by the patient during a period of exercise.

The back supporting element 15 is pivotally adjustable relative to the support element 12, and includes a pair of longitudinal members 62 and 63, first end portions 64 of which are secured by bolts to the support element 12. The second ends 66 thereof are interconnected by a transverse member which cooperates to support a transparent plate 68. Straps 69 and shoulder pads 70 cooperate to engage and position the pelvic areas of the patient during exercise.

The ergometer element 16 may be any of a number of well known types, all of which include a frame 73 supporting a crank 74 driving a sprocket 75. A sprocket chain 76 interconnects the sprocket 75 with a flywheel 77 provided with a disc brake 78, the tension of which can be adjusted to vary the work performed by the patient. Indicating means 79 shows both speed of rotation of the flywheel and the projected distance attained.

The support element 17 is L-shaped in configuration, and includes a vertical member 82 and a horizontal beam 83 which extends between the interstice 84 existing between the members 46 and 47. A pair of clamping plates 85 and 86 engage the outer surfaces of the members 46–47 and are interconnected by shafts 87 and 88 supporting bearings 88A which engage forward and rearward surfaces on the members 46–47 as well as upper and lower surfaces on the beam 83. As the spacing between the bearings is just sufficient to permit vertical and horizontal movement of the beam relative to the members 46–47, a counterclockwise torque (as seen in FIG. 1) exerted by the ergometer element is effectively resisted. Clamping pins 89 and 90 are controlled by hand-operated knobs 91 and 92.

Adjustment of the ergometer element is facilitated by a counterbalancing unit 93 which includes a pair of tension springs 94, first ends of which are secured by a bracket 95 to the rail 20. Second ends 96 engage a bracket engaging a cable 97 entrained about pulleys 98, 99 and 100, the opposite end of the cable being secured to the shaft 90.

Referring again to the back rest element 15, adjustment of this element is obtained by moving the second end 66 to desired location after loosening a locking means 103 on the rod 39. Should during this period the back rest be dropped, the fall is cushioned by a compression spring 104 and a shock absorber 105 concentrically disposed therewith.

It will be apparent that I have invented novel and highly useful improvements in surgical tables adapted for cardiac stress analysis, in which, irrespective of the physical size and proportions of the patient, the ergometer may be conveniently adjusted to a comfortable and clinically appropriate position for exercise. During the period of exercise, the patient is supported in a comfortable and clinically appropriate position for the study in which he is easily scanned without interference between his legs and the camera structure. All of the components comprising the device are ruggedly constructed and easily serviced should replacement prove necessary.

I wish it to be understood that I do not consider the invention limited to the precise details of structure shown and set forth in this specification, for obvious modifications will occur to those skilled in the art to which the invention pertains.

I claim:

1. An improved surgical table for supporting a patient for the development of cardiac stress while performing a cardiac scan, comprising: a horizontal base adapted to be supported upon a floor and having first and second ends; a platform supported in horizontal position adjacent one of said ends at a level substantially in the plane of said base element; a first support element extending upwardly from said base element medially of said ends; a generally planar back rest having a first end pivotally connected to said first support element, and having means for adjustably positioning the angular inclination thereof relative to the horizontal; a second support element extending upwardly from said base element and adjacent said first support element; a seat element positioned adjacent said first end of said back rest and supported in substantially horizontal position by said second support element; said second support element including first and second vertical members defining an interstice; and an ergometer support element including a horizontal beam adjustably supported for longitudinal and vertical movement relative to said base element in said interstice.

2. A surgical table in accordance with claim 1, further comprising counterbalancing means interconnecting said horizontal beam and one of said support elements for compensating for a vertical load applied to said horizontal beam.

3. A surgical table in accordance with claim 1, in combination with an ergometer element, said ergometer element including a pedal-operated crank adjustably positioned in an area at least partially overlying said platform.

4. A surgical table in accordance with claim 3, further comprising means for mounting said horizontal beam in horizontal condition, said last-mentioned means including a pair of generally rectangular plates contacting a pair of oppositely disposed surfaces of said first and second vertical members of said second support element, a pair of bearings interconnecting said plates and resisting torque forces cause by the weight of said ergometer by contacting surfaces of said first and second vertical members and said horizontal beam.

5. A surgical table in accordance with claim 4, including means for moving said plates toward each other to clamp surfaces of said first and second vertical members against side surfaces of said horizontal beam.

* * * * *